United States Patent [19]

Goldfeld et al.

[11] Patent Number: 4,705,237

[45] Date of Patent: Nov. 10, 1987

[54] LAUNCHER FOR AN OPTICALLY GUIDED, WIRE-CONTROLLED MISSILE WITH IMPROVED ELECTRONIC CIRCUITRY

[75] Inventors: Emil Goldfeld; Shlomo Harush, both of Holon; Yuri Takserman, Netanya; Shmuel Weiler, Herzlia, all of Israel

[73] Assignee: The State of Israel, Ministry of Defence, Israel Military Industries, Israel

[21] Appl. No.: 919,666

[22] Filed: Oct. 16, 1986

[30] Foreign Application Priority Data

May 12, 1986 [IL] Israel ..... 78757

[51] Int. Cl.[4] ..... F41G 7/32

[52] U.S. Cl. ..... 244/3.12; 244/3.11

[58] Field of Search ..... 244/3.12, 3.11, 3.14

[56] References Cited

U.S. PATENT DOCUMENTS

| | | | |
|---|---|---|---|
| 3,233,847 | 2/1966 | Girsberger | 244/3.12 |
| 3,366,346 | 1/1968 | McKnight et al. | 244/3.12 |
| 3,711,046 | 1/1973 | Barhydt et al. | 244/3.12 |
| 4,406,429 | 9/1983 | Allen | 244/3.11 |
| 4,474,343 | 10/1984 | Zwirn et al. | 244/3.11 |

*Primary Examiner*—Charles T. Jordan

*Attorney, Agent, or Firm*—Steinberg & Raskin

[57] ABSTRACT

Launcher for a tube-launched, optically guided wire controlled missile. In the electronic circuitry that forms part of a feedback servomechanism there are provided pitch and yaw channels with time variable gains having different transfer functions. Optionally there are further provided at least two different generators of signals for gravity bias with automatic means for selecting between them in accordance with the physical characteristics of the missile.

4 Claims, 4 Drawing Figures

LAUNCHER FOR AN OPTICALLY GUIDED, WIRE-CONTROLLED MISSILE WITH IMPROVED ELECTRONIC CIRCUITRY

FIELD OF THE INVENTION

The present invention relates to guided anti-tank missile systems, more particularly to such systems that comprise a wire command guidance link.

BACKGROUND OF THE INVENTION

Modern weapons systems rely heavily on the use of electronics to provide system operators with increased control capabilities. An example of this is a tube-launched, optically tracked wire-guided anti-tank missile such as the TOW missile developed by the Hughes Aircraft Corporation for the U.S. Army in the 1960's.

Guided missiles of this type fly to the point indicated in the crosshairs of a launcher's sight within a design range of the missile, e.g. 3,750 meters in case of a TOW missile. The tracking system optically tracks a flare originating from the back of the missile, e.g. in the infra-red range, and sends guidance signals through two fine steel wires attached to and dispensed from the missile during its flight. The tracking system may be mounted on the missile launcher tube and its major components are a trackable optical sight, a missile tracker and a guidance set. A gunner tracks the target by keeping the crosshairs of the optical sight on the target. The missile tracker senses the optical, e.g. infra-red flare on the missile and generates signals representing the missile's deviation from the gunner's line-of-sight in the horizontal and vertical plane. This deviation appears in the form of error signals which are processed by a feedback control loop in the guidance set. The guidance set produces a correction guidance signal which is sent to the missile by the wire link and the missile responds to these signals by servomechanism deflection of control fin surfaces located at the rear of the missile.

In the following the invention will at times be described with reference to the TOW missile, it being understood that it is not confined thereto.

The TOW missile system uses a command to line-of-sight guidance concept. The function of the guidance set is to minimize missile trajectory deviations due to error sources such as gunner jitter, tracker and sensor noise, gusts and cross-winds, flight motor thrust axis misalignments, system imbalances, variations in launch conditions, etc.

Since its development, the TOW missile system has seen combat experience which has provided important information as to its overall utility. While the missile itself is capable of a range of 3,750 meters, the original guidance set was not designed to effectively utilize the maximum range. The need to utilize the missile at its maximum range is apparent, especially in regard to developments which have increased the firing range of new tanks. Investigation of the hit probabilities for the existing TOW missile system have revealed that the chance of a target hit at a range of 3,500 meters is 73.5% for a good gunner. For a poor gunner, the chance of a target hit for a range of 3,500 meters is only 7.5%. Thus, it would be desirable to improve the performance of the original TOW missile system guidance set so as to exploit the longer range of the basic TOW missile.

An analysis into the performance of the existing guidance set was performed and the following was revealed:

1. The inherent TOW missile construction provides low aerodynamic damping which makes it highly susceptible to the effects of aerodynamic forces, resulting in fluctuations during its flight.
2. Over the longer range of flight, the gunner must maintain his sight on the target for a longer period of time. The feedback control system depends on the steadiness and the aiming ability of the gunner.
3. During flight internal inertial forces are relied upon to guide the missile to its target, and initially introduced errors in its trajectory grow over time. The control loop is thus required for reconciling the need to correct larger errors as time goes on, with the fact that with longer flight time, i.e. with an increase of the error gain, the control loop may become unstable.
4. Large oscillations of the missile around trim position create a decrease in missile speed through increased wind resistance.

The above summarizes the limitations of the existing TOW missile system with regard to exploitation of the maximum missile range. It is accordingly an object of the present invention to improve the guidance set of a tube-launched, optically tracked, wire-guided missile such as, for example, the TOW missile and to achieve thereby an increased target hit probability over the maximum missile range.

Tube-launched missiles of the kind specified comprise a flight motor which expires a few seconds after launching and a relatively long time before the missile hits its target. In the flight control of a tube-launched missile of the kind specified it is accordingly necessary to ensure that the missile flies along the desired flight trajectory, usually close to the ground surface, and avoid premature landing even after the expiry of the flight motor, and to this end a so-called gravity bias input is applied to one of the control loop stages. By this input the angle of attack of the missile is caused to vary with time in synchronism with the gradual reduction of the missile velocity thereby insuring that the missile maintains a desired lift also after the flight motor has expired. In order to achieve this, the gravity bias applied to the flight control has to be designed so as to take into account the change of the velocity in time. The rate of reduction of velocity is a function of the weight and geometry of the missile.

The gravity bias further ensures that the missile keeps a predetermined trajectory during the first few seconds after launching when sighting of the target is impossible due to smoke and dust created during launching.

Modern battle conditions often require the use of two or more different missiles having the same electronic guidance system but differing from each other in their weight and/or geometry. The electronic control system including the gravity bias is built into the launcher and consequently in accordance with the state of the art, where different types of missiles with similar electronic controls but requiring different gravity biases are to be launched from a given site, different launchers are required for each type of missile. This constraint is burdensome and onerous, in particular where great mobility and simplicity of operation are required and it is therefore another object of the present invention to provide a multi-purpose launcher for tube-launched, optically tracked wire-guided missiles adapted for the launching of two or more different missiles having the same electronic control system but having different physical characteristics (weight and geometry) and therefore requiring different gravity bias values.

Once rolling of the missile about its longitudinal axis has stopped, two types of corrections are required for the flight control of a TOW missile, namely the correction of the elevation pitch and the correction of the azimuth or yaw, and for this purpose two separate channels are needed. In conventional TOW missiles and two channels have identical time variable gains.

GENERAL DESCRIPTION OF THE INVENTION

The present invention is based on the finding that the performance of a tube-launched optically tracked, wire-controlled missile can be improved and thereby the effective range at which high accuracy is maintained be increased by assigning different time variable gains for the correction of pitch and yaw errors. Thus, by a first aspect of the invention there is provided a launcher for a tube-launched, optically guided, wire controlled missile comprising an electronic circuitry forming part of a feedback servomechanism control loop in which the pitch and yaw channels have additional time variable gains with different transfer functions which are generated digitally.

In addition, there is provided in accordance with the invention in conjunction with the existing compensation network a lead-lag filter whose characteristics vary with time. Such a lead-lag filter introduces the necessary phase shift, e.g. lead in case of the TOW missile, for stabilizing the control dynamics. Such time variable lead-lag filter may, for example, comprise two discrete stages activated consecutively, changing the damping factor once in the course of the flight at a predetermined point of time.

In accordance with a further aspect of the invention there is provided a launcher for a tube-launched, optically guided, wire-controlled missile comprising an electronic circuitry forming part of a feedback compensation control loop. This electronic circuitry preferably incorporates at least two gravity bias circuits associated with the pitch channel which are selected by an automatic, operator independent selector in accordance with the physical characteristics of the missile loaded in the launcher.

DESCRIPTION OF THE DRAWINGS

For better understanding, the invention will now be described with reference to the annexed drawings in which:

In FIGS. 2–4 any blocks newly added in accordance with the invention are shown in bold lines.

DESCRIPTION OF A PREFERRED EMBODIMENT

Figure 1:
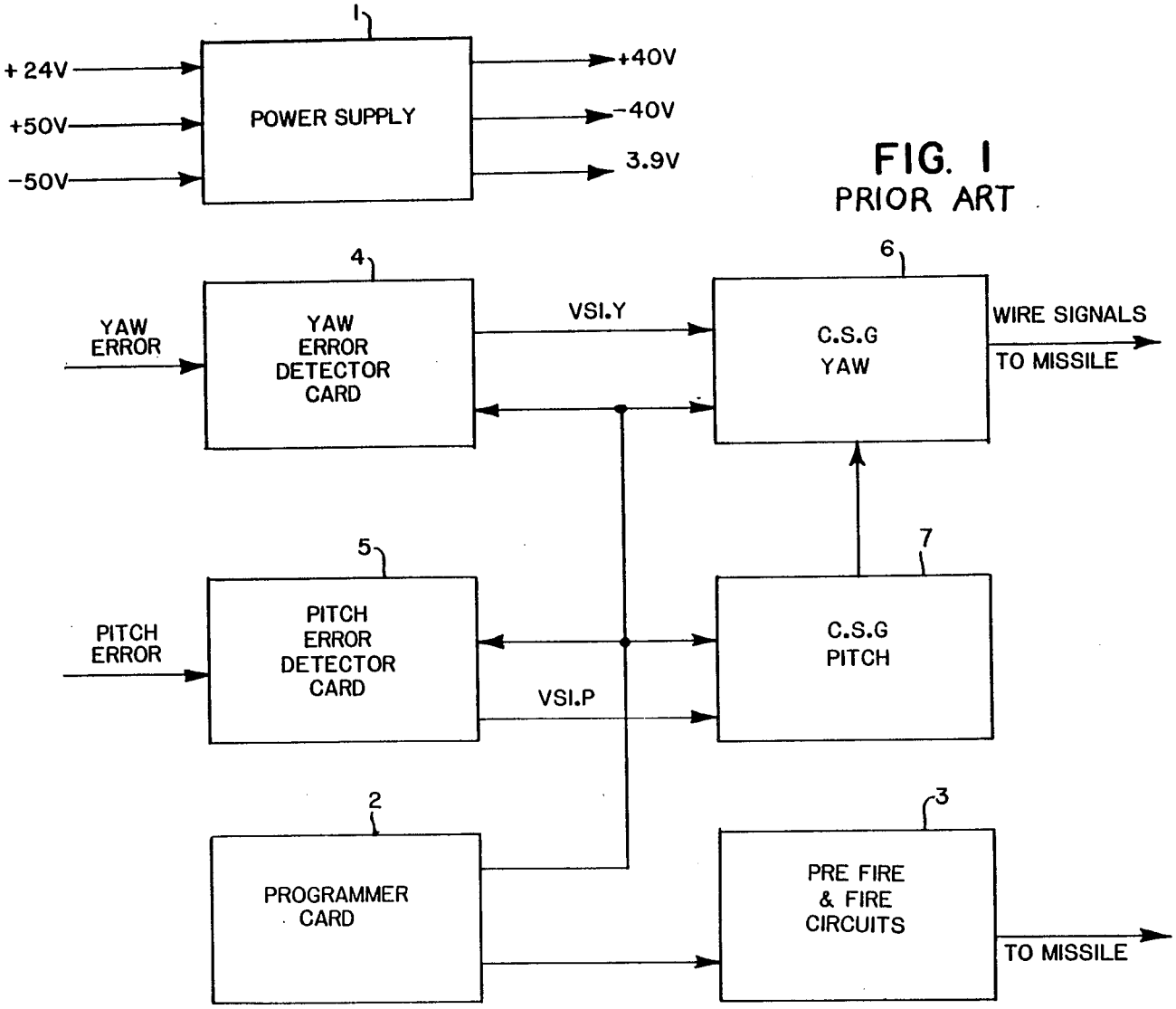
FIG. 1 PRIOR ART
FIG. 1 is a block diagram of a prior art TOW missile guidance set.

The prior art TOW missile guidance set shown by way of block diagram in FIG. 1, comprises a power supply 1, a programmer card 2 and a pre-fire and fire circuitry 3 which is operational only for launching the missile. The guidance set proper comprises yaw and pitch (azimuth and elevation respectively) error detection cards 4 and 5 and yaw and pitch command signal generators 6 and 7. In operation the correction signals for the yaw and pitch are conducted to the missile via the wires.

Figure 2:
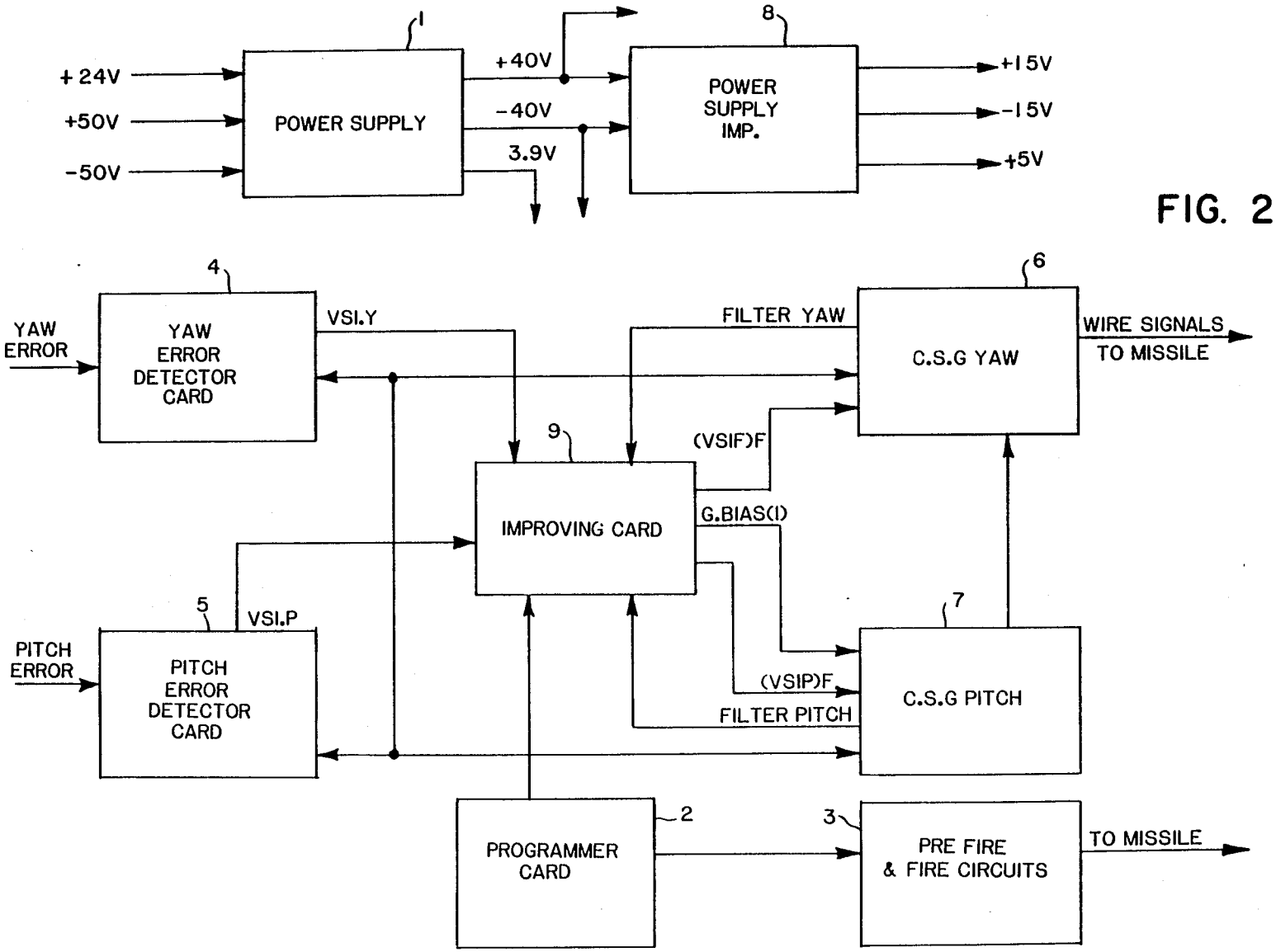
FIG. 2 is a block diagram of a missile guidance set according to the invention.

The missile guidance set according to the invention shown by way of block diagram in FIG. 2 comprises the same elements 1–7 as in FIG. 1 and they have been indicated with the same reference numerals. In addition there is provided in accordance with the invention an extra power supply 8 for supplying the additional outputs of +15 V, −15 V and +5 V required for analog and digital state of the art electronics. The guidance system further comprises an improving card 9 including elements such as a time variable gain circuit comprising, i.a. a read only memory (ROM) which stores the variables required for the time variable gain, a time variable filter unit which comprises at least two consecutively operating lead-lag filters which introduce the necessary phase shift to increase stability, and at least one electronic circuit for gravity bias whose values are stored in a read only memory (ROM) and which is required for the pitch (elevation) corrections only.

The pitch and yaw channels of the TOW missile guidance set in accordance with the invention will now be described separately with reference to FIGS. 3 and 4 respectively.

Figure 3:
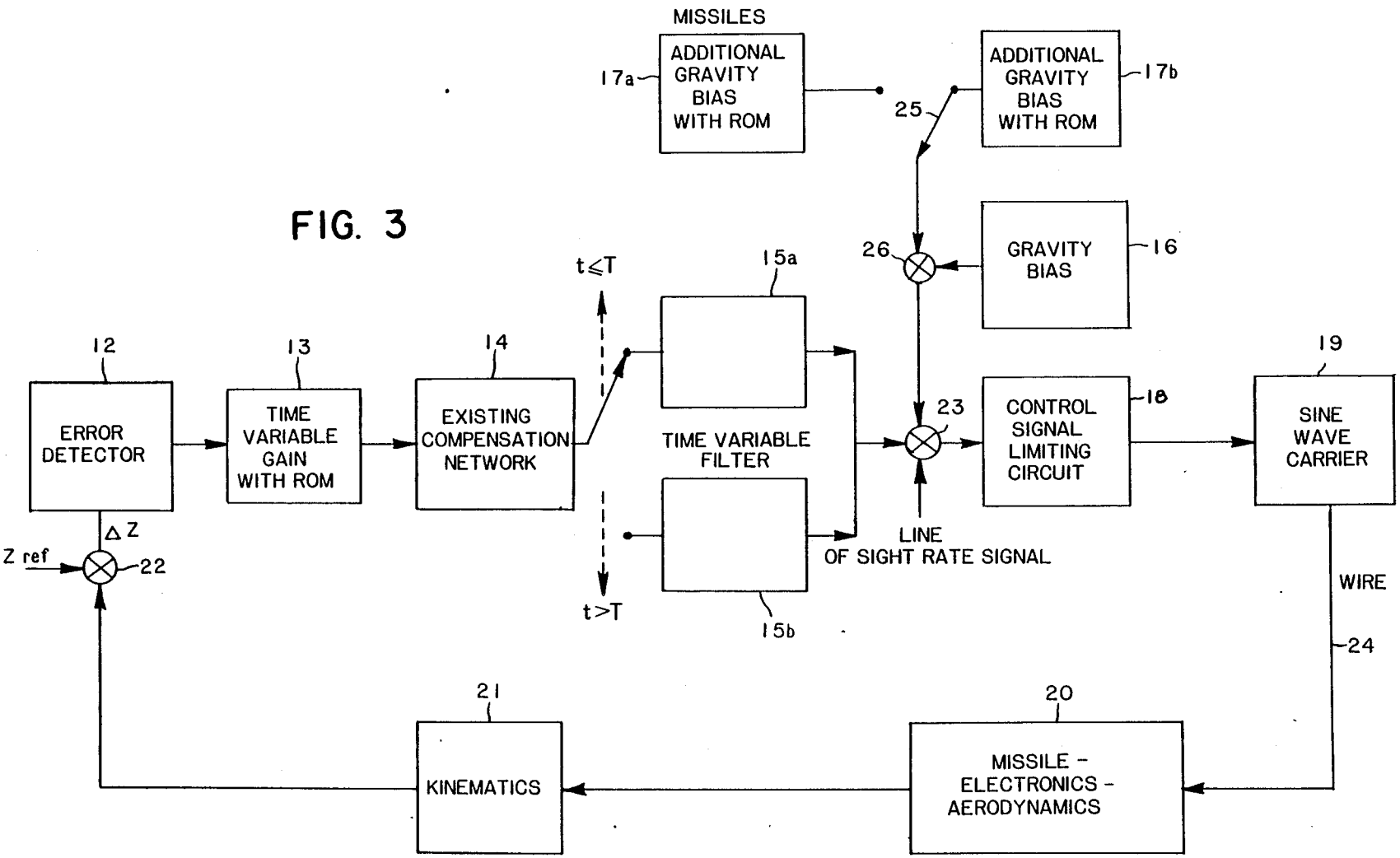
FIG. 3 is a block diagram of the pitch (elevation) channel of a missile guidance set according to the invention.

Turning first to FIG. 3 it is seen that the channel comprises an error detector 12, a time variable gain stage 13 with ROM, a compensation network 14 and a time variable lead-lag filter comprising two stages 15*a* and 15*b* activated consecutively, a gravity bias stage 16, two additional gravity bias stages 17*a* and 17*b* with ROM for alternative operation with different missiles, a control signal limiting circuit 18, a sine wave carrier 19, the missile 20 including, i.a., missile electronics and aerodynamic control surfaces, and kinematics 21 for the feedback transmission of the missile position to the error detector 12.

In operation, a pitch reference $Z_{ref}$ signal and a feedback signal which reflects the error are summed at summing point 22 and the differential signal $\Delta Z$ is fed into the error detector 12. The object of the ROM in the time variable gain stage 13 is to vary the amplification of the error signal in synchronism with flight time. To this end the ROM thereof stores a series of increasing gain values which are output as the missile progresses in flight and in consequence the transfer function of this gain block varies (i.e. increases) over time to maintain an optimum gain margin over flight time (the gain margin being a factor in the maintenance of stability).

The signal coming from the time variable gain stage 13 is fed into the compensation network 14 which is of conventional design and introduces phase lead for stability and produces sharp noise cut-off at the high frequency end and a large gain for error reduction at the low frequency end. The time variable filter stage comprising circuits 15*a* and 15*b*, the so-called lead-lag filters, introduces a phase lead for stabilizing the control dynamics and filter out operator noises. Circuits 15*a* and 15*b* are operated consecutively, the switch-over from one to the other occurring automatically at a predetermined time T, the object being to compensate the reduction of flight stability resulting from the increase, say after 4.4 seconds, of the error gain with flight time. The output from the time variable filter stage 15*a* or 15*b* is summed at 23 with a gravity bias signal (see below) and a line of sight rate signal, and the output is fed into the control signal limiting circuit 18 and sine wave carrier 19, the output from the latter being transmitted via the wire 24 to the electronics of the missile 20 which control the flight surfaces and also generate the feedback signal that is received by the kinematics 21. The output signal of kinematics 21 is summed at summing point 22. The control signal limiting circuit ensures that the angle of attack of the missiles does not exceed the structural capabilities of the air frame and that at the same time the control signal remains below levels at which excessive coupling between the yaw and pitch channels could give rise to a roll effect.

The sine wave carrier 19 serves for summing the control signals in the launcher before being sent to the missile via the wire link.

The guidance set as shown in FIG. 3 further comprises two alternative gravity bias stages 17*a* and 17*b* and in the launcher there are provided selector means 25 which select automatically the correct gravity bias depending on the physical characteristics of the missile. In the specific case of FIG. 3 only two alternative gravity bias functions are provided and the selector 25 is designed to select between these two. However, in a similar way it is possible to devise three or more different gravity bias functions and automatic selector means designed to select between them.

The gravity bias function 17*a* and 17*b* operate in association with the conventional gravity bias stage 16 and the outputs from the two gravity bias functions are summed at 26 and the combined signal is fed into summing point 23 which sums together the gravity bias signal, the signal emerging from the time variable filter and the liner of sight rate signal. The combined signal is fed into the command signal limit generator 18 as specified.

Figure 4:
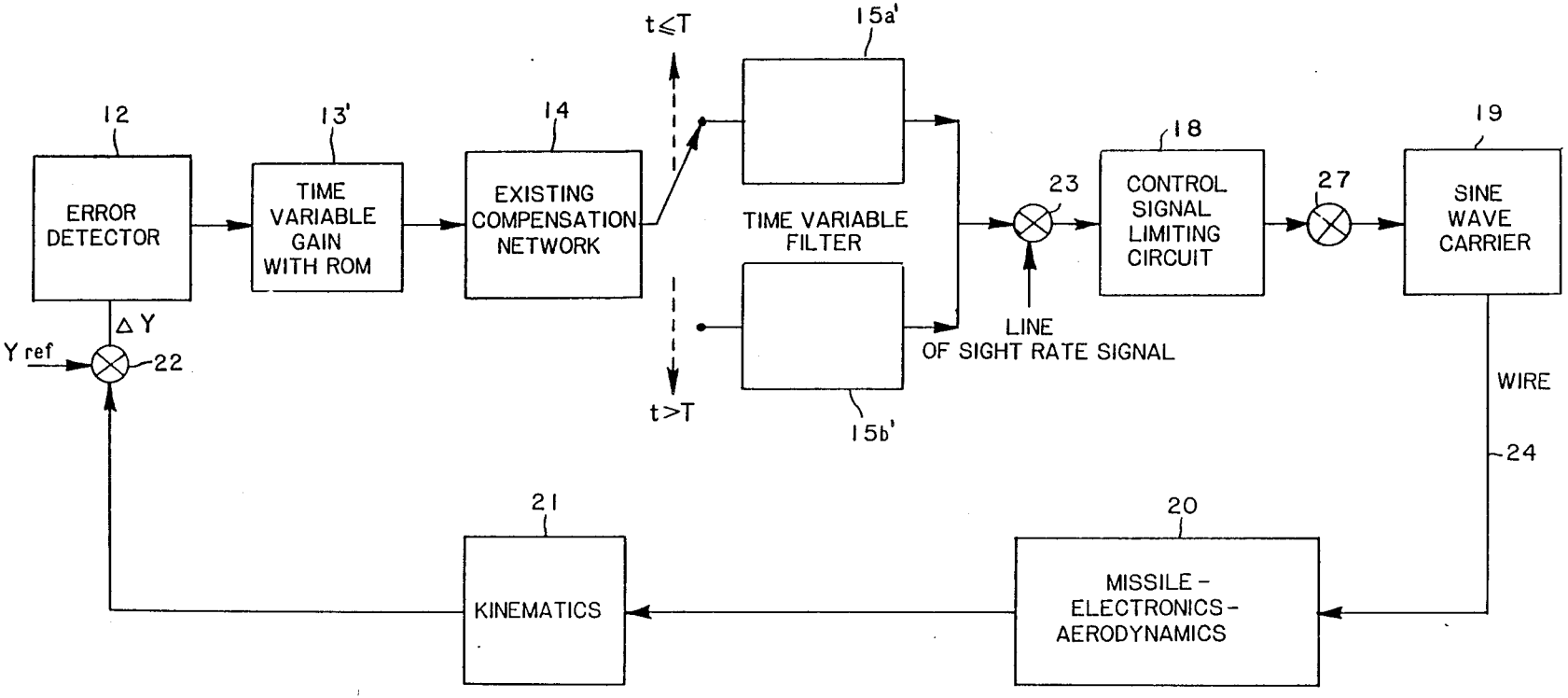
FIG. 4 is a block diagram of the yaw (azimuth) channel in a missile guidance set according to the invention.

The block diagram of the yaw channel shown in FIG. 4 is partly similar to the pitch channel shown in FIG. 3 and blocks representing similar functions are marked with the same reference numerals. Seeing however that the time variable gain stage represents different values the numeral here is 13'. The time variable filter stages 15*a'* and 15*b'*, the so-called lead-lag filter, may represent the same or different values than and/or may be designed to operate at the same or different times as the corresponding time variable filter stages in the pitch channel.

We claim:

1. A launcher for a tube-launched, optically guided, wire-controlled missile, comprising: a feedback servomechanism controlled loop including electronic circuitry having pitch and yaw channels, each of said pitch and yaw channels having respective time variable gain circuit means for acting on a respective one of pitch and yaw error signals in accordance with a respective transfer function, and wherein said transfer function of said time variable gain circuit of said pitch channel is different from said transfer function of said time variable gain circuit of said yaw channel.

2. A launcher for a tube-launched, optically guided, wire-controlled missile according to claim 1, characterized by comprising a time variable lead-lag filter.

3. A launcher for a tube-launched, optically guided, wire-controlled missile according to claim 2, characterized by comprising at least two discrete filters operating consecutively with automatic switch-over at predetermined times.

4. A launcher for a tube-launched, optically guided, wire-controlled missile according to claim 1, characterized in that the electronic circuitry comprises at least two different generators of signals for gravity bias associated with the pitch channel, in combination with automatic selector means by which a desired gravity bias signal generator is selected in accordance with the physical characteristics of the missile loaded in the launcher.

* * * * *